US010004118B1

(12) United States Patent
Mi

(10) Patent No.: US 10,004,118 B1
(45) Date of Patent: Jun. 19, 2018

(54) LED CONTROL CIRCUIT AND METHOD THEREFOR

(71) Applicant: SEMICONDUCTOR COMPONENTS INDUSTRIES, LLC, Phoenix, AZ (US)

(72) Inventor: Ningliang Mi, Arlington Heights, IL (US)

(73) Assignee: SEMICONDUCTOR COMPONENTS INDUSTRIES, LLC, Phoenix, AZ (US)

( * ) Notice: Subject to any disclaimer, the term of this patent is extended or adjusted under 35 U.S.C. 154(b) by 0 days. days.

(21) Appl. No.: 15/592,722

(22) Filed: May 11, 2017

(51) Int. Cl.
*H05B 33/08* (2006.01)

(52) U.S. Cl.
CPC ..... *H05B 33/083* (2013.01); *H05B 33/0812* (2013.01); *H05B 33/0845* (2013.01)

(58) Field of Classification Search
None
See application file for complete search history.

(56) References Cited

U.S. PATENT DOCUMENTS 9,544,961 B1 * 1/2017 Howe ..... H05B 33/083

OTHER PUBLICATIONS

Altoran Chips & Systems, Inc., "ASC0804, Compact Direct AC Line LED Driver with high PF and low THD using Only Two External Components," Datasheet Rev2.0, 9 pages, available at http://www.altorancns.com/assets/pdf/datasheet_acs0804.pdf, as printed on May 8, 2017.

Texas Instruments, "TPS92411x Floating Switch for Offline AC Linear Direct Drive of LEDs with Low Ripple Current," Datasheet, Revised Jul. 2014, 29 pages.

* cited by examiner

*Primary Examiner* — Jany Richardson
(74) *Attorney, Agent, or Firm* — Robert F. Hightower

(57) ABSTRACT

In an embodiment, an LED control circuit may include a first circuit configured to form a reference signal having a waveform of a rectified ac signal. The LED control circuit may also include a first regulator circuit configured to regulate a first LED current from a first LED during a first portion of the reference signal to have a waveshape that follow the reference signal waveform but not receive the first current during a second portion of the reference signal. The LED control circuit may also include a second regulator circuit configured to regulate a second current from the first LED and from a second LED during the second portion of the reference signal to have a waveshape that follows the reference signal waveform.

20 Claims, 5 Drawing Sheets

LED CONTROL CIRCUIT AND METHOD THEREFOR

BACKGROUND OF THE INVENTION

The present invention relates, in general, to electronics, and more particularly, to semiconductors, structures thereof, and methods of forming semiconductor devices.

In the past, the electronics industry provided various circuits for controlling light emitting diodes (LEDs). Some of the LED control circuits operated directly from an input AC line voltage and were often referred to as direct AC drive (DACD) circuits. In some applications, some of the DACD circuits resulted in distortion of the input current received from the AC line. In some cases, the operation of the DACD circuit did not adhere to the International Electro-technical Commission (IEC) distortion specification. Such as for example IEC6000-3-2.

Accordingly, it is desirable to have an embodiment of a DACD control circuit that has lower distortion, or an embodiment that may have lower distortion of the AC input line current.

Figure 1:
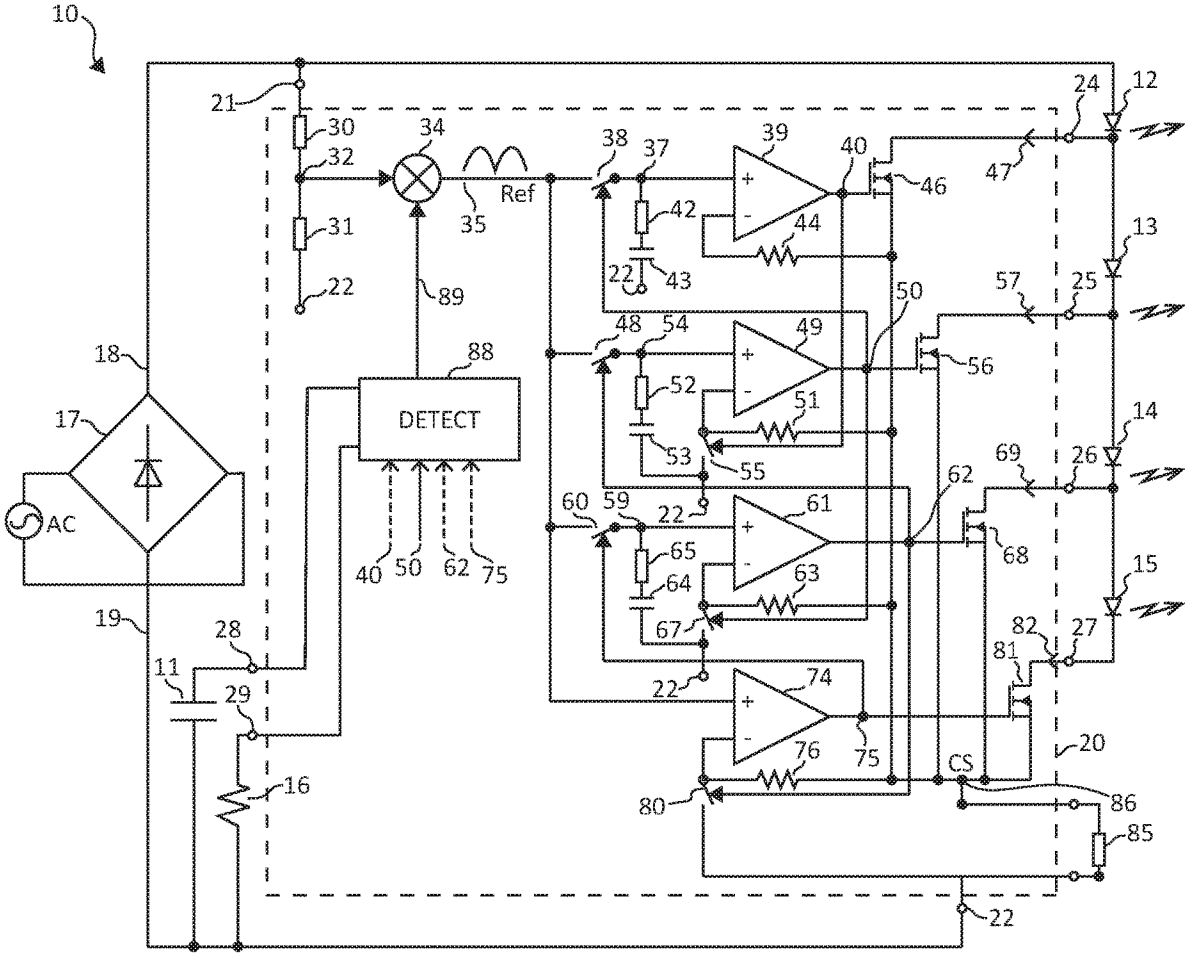
FIG. 1 schematically illustrates an example of an embodiment of a portion of an LED system 10 that includes an LED control circuit or controller in accordance with the present invention.

For simplicity and clarity of the illustration(s), elements in the figures are not necessarily to scale, some of the elements may be exaggerated for illustrative purposes, and the same reference numbers in different figures denote the same elements, unless stated otherwise. Additionally, descriptions and details of well-known steps and elements may be omitted for simplicity of the description. As used herein current carrying element or current carrying electrode means an element of a device that carries current through the device such as a source or a drain of an MOS transistor or an emitter or a collector of a bipolar transistor or a cathode or anode of a diode, and a control element or control electrode means an element of the device that controls current through the device such as a gate of an MOS transistor or a base of a bipolar transistor. Additionally, one current carrying element may carry current in one direction through a device, such as carry current entering the device, and a second current carrying element may carry current in an opposite direction through the device, such as carry current leaving the device. Although the devices may be explained herein as certain N-channel or P-channel devices, or certain N-type or P-type doped regions, a person of ordinary skill in the art will appreciate that complementary devices are also possible in accordance with the present invention. One of ordinary skill in the art understands that the conductivity type refers to the mechanism through which conduction occurs such as through conduction of holes or electrons, therefore, that conductivity type does not refer to the doping concentration but the doping type, such as P-type or N-type. It will be appreciated by those skilled in the art that the words during, while, and when as used herein relating to circuit operation are not exact terms that mean an action takes place instantly upon an initiating action but that there may be some small but reasonable delay(s), such as various propagation delays, between the reaction that is initiated by the initial action. Additionally, the term while means that a certain action occurs at least within some portion of a duration of the initiating action. The use of the word approximately or substantially means that a value of an element has a parameter that is expected to be close to a stated value or position. However, as is well known in the art there are always minor variances that prevent the values or positions from being exactly as stated. It is well established in the art that variances of up to at least ten percent (10%) (and up to twenty percent (20%) for some elements including semiconductor doping concentrations) are reasonable variances from the ideal goal of exactly as described. When used in reference to a state of a signal, the term "asserted" means an active state of the signal and the term "negated" means an inactive state of the signal. The actual voltage value or logic state (such as a "1" or a "0") of the signal depends on whether positive or negative logic is used. Thus, asserted can be either a high voltage or a high logic or a low voltage or low logic depending on whether positive or negative logic is used and negated may be either a low voltage or low state or a high voltage or high logic depending on whether positive or negative logic is used. Herein, a positive logic convention is used, but those skilled in the art understand that a negative logic convention could also be used. The terms first, second, third and the like in the claims or/and in the Detailed Description of the Drawings, as used in a portion of a name of an element are used for distinguishing between similar elements and not necessarily for describing a sequence, either temporally, spatially, in ranking or in any other manner. It is to be understood that the terms so used are interchangeable under appropriate circumstances and that the embodiments described herein are capable of operation in other sequences than described or illustrated herein. Reference to "one embodiment" or "an embodiment" means that a particular feature, structure or characteristic described in connection with the embodiment is included in at least one embodiment of the present invention. Thus, appearances of the phrases "in one embodiment" or "in an embodiment" in various places throughout this specification are not necessarily all referring to the same embodiment, but in some cases it may. Furthermore, the particular features, structures or characteristics may be combined in any suitable manner, as would be apparent to one of ordinary skill in the art, in one or more embodiments.

The embodiments illustrated and described hereinafter suitably may have embodiments and/or may be practiced in the absence of any element which is not specifically disclosed herein.

DETAILED DESCRIPTION OF THE DRAWINGS

FIG. 1 schematically illustrates an example of an embodiment of a portion of an LED system 10 that includes an LED control circuit or controller 20. System 10 includes a bridge rectifier 17 that receives an AC voltage, such as from an AC line voltage, and rectifies the AC voltage to form a rectified AC signal 18 that is referenced to a common return 19. Signal 18 generally has a waveshape of a full wave rectified AC signal, although it may have other waveshapes in other embodiments. System 10 also includes a plurality of LEDs 12-15 that are connected together in a series string.

Circuit 20 receives signal 18 as an input signal on an input terminal or input 21. Signal 18 may also be used to provide operating power to controller 20 between input 18 and a common return signal 19 on an input 22. Circuit 20 also includes a first LED input 24 that is configured to be connected to a first terminal of LED 12, a second LED input 25 that is configured to be connected to a first terminal of LED 13, a third LED input 26 that is configured to be connected to a first terminal of LED 14, and a fourth LED input 27 that is configured to be connected to a first terminal of LED 15. Although the example embodiment of controller 20 is illustrated as controlling four LEDs, controller 20 may be configured control more or fewer LEDs. System 10 may also include a current sense resistor 85. Although resistor 85 is illustrated as being external to controller 20, in some embodiments resistor 85 may be internal to controller 20. An embodiment may include that resistor 85 may be an adjustable resistor to allow a user to select the total amount of current. Additionally, some embodiments may use a different type of current sense element instead of resistor 85.

Controller 20 includes a plurality of current regulator circuits that are configured to regulate LED currents from one or more of LEDs 12-15. In an embodiment, controller 20 may be configured to use one current regulator circuit to regulate a first LED current from only a first LED of LEDs 12-15 during a first portion of the reference signal in response to the reference signal but to not receive of conduct the first current during a second portion of the reference signal. Some embodiments may include that the first portion may be a portion that is representative of signal 18 having a first value, which in an embodiment may be a value representative of a value of signal 18 that may be greater than a threshold value of an LED. An embodiment may include that the second portion may be a portion that is representative of signal 18 having a second value, which in an embodiment may be a value representative of a value of signal 18 that may be greater than a threshold value of at least two LEDs. An embodiment may also include that the one current regulator may not receive or regulate an LED current from other LEDs of LEDs 12-15. Controller 20 may also be configured to use another current regulator circuit to regulate a second current from the first LED and from a second LED during the second portion of the reference signal in response to the reference signal. An embodiment may also include that the another current regulator may only receive the current from LEDs 12-13 and not receive or regulate an LED current from other LEDs of LEDs 12-15. A current regulator circuit of controller 20 may have an embodiment that may include a transistor 46, an amplifier 39, and a switch 38. Amplifier 39 may have an embodiment that may be configured to form a drive signal 40 to drive transistor 46. Another current regulator circuit may have an embodiment that may include a transistor 56, an amplifier 49, a switch 48, and a switch 55. Amplifier 49 may have an embodiment that may be configured to form a drive signal 50 to drive transistor 56. Yet another current regulator circuit may have an embodiment that may include a transistor 68, an amplifier 61, a switch 60, and a switch 67. Amplifier 61 may have an embodiment that may be configured to form a drive signal 62 to drive transistor 68. Another current regulator circuit may have an embodiment that may include a transistor 81, an amplifier 74, and a switch 80. Amplifier 74 may have an embodiment that may be configured to form a drive signal 75 to drive transistor 81.

Controller 20 may also include an optional on-time detection circuit or detect circuit 88 that may have an embodiment that may be configured to receive a signal that can be processed to measure an on-time of one or more of LEDs 12-15 and form an adjust signal 89 that is representative of that on-time. An embodiment may include that circuit 88 may be configured to receive a signal that is representative of the on-time of the one or more LEDs. In an embodiment, circuit 88 may be configured to receive a signal that is representative of a drive signal, or alternately an off-time, of one or more of transistors 46, 56, 68, and 81 and form signal 89. For example, circuit 88 may receive one or more of signals 40, 50, 62, or 75 and form signal 89 that is representative of the on-time of one or more of respective LEDs 12-15. An embodiment of circuit 88 may receive one or more of signals 40, 50, 62, or 75 that may be representative of the on-time of one or more of LEDs 12-15. An embodiment of circuit 88 may be configured to use an optional capacitor 11 and optional resistor 19 to assist in forming signal 89.

Circuit 20 may also have an embodiment that may include an adjustable reference circuit 34. An optional voltage divider circuit may receive signal 18 and form a signal 32 that is representative of signal 18 but at a lower voltage that can be more easily used by the elements of circuit 20. Circuit 34 may, in some embodiments, be configured to receive signal 32 and form a reference signal 35 that has a waveshape that is substantially similar to the waveshape of signal 18. An optional embodiment of circuit 34 may be configured to adjust the value of signal 35 inversely to changes in the on-time of, or alternately to the on-time of one or more of LEDs 12-15. For example, circuit 34 may adjust the amplitude of signal 35 in response to the value of signal 89, for example inversely proportional to signal 89. For example, if the peak voltage of signal 18 increases, the conduction time or on-time of one or more of LEDs 12-15 may increase. Circuit 88 may change the value of signal 89 in response to the change in the on-time, and circuit 34 may inversely adjust the value of signal 35 in response to the change in the on-time. Changing the value of signal 35 adjusts amplitude of the current through LEDs 12-15 to assist in forming a more uniform light luminous intensity for LEDs 12-15.

As will be seen further hereinafter, an embodiment of controller 20 may be configured to couple a first current regulator circuit of the plurality of current regulator circuits to receive a first LED current from a first LED of the plurality of series coupled LEDs and regulate the first current during a first portion of the input signal to have a waveshape that follows the input signal waveform wherein the input signal increases from a first value to a second value and wherein the first current regulator circuit does not regulate the first current during a second portion of the input signal; and the control circuit may also be configured to couple a second regulator circuit of the plurality of regulator circuits to receive a second LED current from the first LED and from a second LED of the plurality of series coupled LEDs and regulate the second current during a second portion of the input signal to have a waveshape that follows the input signal waveform wherein the input signal increases from a value no less than the second value to a third value and wherein the second regulator circuit does not regulate the second current during the first portion or a third portion of the input signal. In an embodiment, the first regulator circuit may not receive a current from any of the other LEDs of the plurality of LEDs, and the second regulator circuit may be configured to receive an LED current from only the first and second LEDs but not from any other LEDs of the plurality of LEDs.

Figure 2:
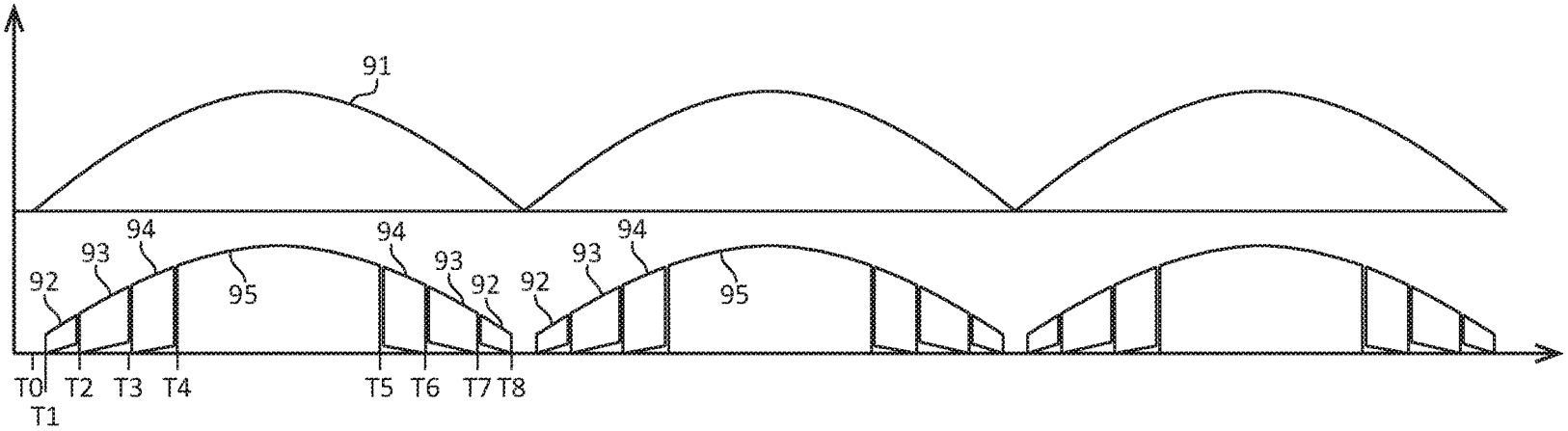
FIG. 2 is a graph having plots that illustrate examples of some of the signals that may be formed during the operation of an embodiment of the circuit of FIG. 1 in accordance with the present invention.

FIG. 2 is a graph having plots that illustrate examples of some of the signals that may be formed during the operation of an embodiment of circuit 20. The abscissa indicates time and the ordinate indicates increasing value of the illustrated signals. A plot 91 illustrates an example of an input signal received by circuit 20, such as for example signal 18 or signal 32. A plot 92 illustrates current 47 through transistor 46, a plot 93 illustrates current 57 through transistor 56, a plot 94 illustrates current 69 through transistor 68, and a plot 95 illustrates current 82 through transistor 81. This description has references to FIG. 1 and FIG. 2.

Assume that at a time T0, signal 18 is substantially zero and is beginning to increase as illustrated by plot 91, thus, signal 35 is also substantially zero. Assume that the voltage of signal 18 at time T0 is less than the forward voltage across LED 12, thus, there is no current flowing through any of LEDs 12-15. Therefore, a current sense signal 86 will also be substantially at the value of the common reference voltage on input 22. Thus the inverting input of amplifiers 39, 49, 61, and 74 will all be at substantially the common reference voltage. The non-inverting input of amplifier 39 will have a higher value than the inverting input due to the voltage from a reference voltage or reference 43, thus, amplifier 39 will form signal 40 at a high voltage, near to the power supply voltage supplied to operate amplifier 39. The high from signal 40 closes switch 55 which forces signal 50 also to be a high value. The high from signal 50 closes switch 67 and amplifier 61 drives signal 62 high. The high from signal 50 also closes switch 38 so that amplifier 39 receives signal 35. The high from signal 62 closes switch 80 which causes amplifier 74 to drive signal 75 high. The high from signal 62 also closes switch 48 so that amplifier 49 receives signal 35. The high from signal 75 closes switch 60 so that amplifier 61 receives signal 35. Thus, all of transistors 46, 56, 68, and 81 are enabled. In an embodiment, switches 55, 67, and 80 may be formed to include a transistor that is enabled when the respective signal 40, 50, or 62 is greater than some fraction of the value of the threshold voltage of respective transistors 56, 68, and 81, such as for example greater than approximately one-half of the value of the threshold voltage. The voltage at which switches 55, 67, and 80 are enabled may be different in other embodiments. An embodiment may include that switches 38, 48, and 60 may be formed to include a transistor that is enabled when the respective signal 50, 62, or 75 is greater than the value of the threshold voltage of respective transistors 56, 68, and 81. The voltage at which switches 38, 48, and 60 are enabled may be different in other embodiments.

Assume that at time T1 signal 18 increases in value to be substantially equal to the forward voltage of LED 12. Because signal 40 is high, transistor 46 is enabled which causes current 47 to flow through LED 12 and transistor 46. Since the value of signal 18 is not sufficient to turn on LEDs 13-15, current does not flow through LEDs 13-15 even though transistors 56, 68, and 81 are enabled by signals 50, 62, and 75. Current 47 causes current sense signal 86 to increase and substantially follow the waveform of signal 18. Consequently, amplifier 39 forms signal 40 to be substantially equal to or slightly greater than the threshold voltage of transistor 46 and to regulate the value of current 47 to substantially follow the waveform of signal 35, thus signal 18, thereby providing power factor correction. An embodiment may include that transistor 46 operates in the linear operational region to regulate current 47.

Assume that at time T2 the value of signal 18 increases to be substantially equal to the forward voltage of LEDs 12 and 13. Since transistor 56 is enabled, current 57 begins to flow through LEDs 12 and 13 and transistor 56. Because switch 55 is closed, amplifier 49 does not regulate the value of current 57. Therefore, the value of signal 86 increases to be greater than the value of signal 35 which causes amplifier 39 to reduce the value of signal 40 to a value which disables transistor 46 thereby terminating current 47. The lower value of signal 40 also disables switch 55 thereby enabling amplifier 49 to regulate the value of current 57 to follow the waveform of signal 35, thus signal 18. The lower value of signal 50 also disables switch 38 and decouples the first regulator circuit from receiving signal 35, thereby ensuring that transistor 46 remains disabled. Current 57 flows through LEDs 12 and 13 and the second regulator circuit regulates current 57 to have a waveform that is substantially the same as the waveform of signal 18 thereby providing power factor correction. An embodiment may include that transistor 56 operates in the linear operational region to regulate current 57. During this interval, transistor 46 is disabled and the corresponding current regulator does not regulate any LED current.

Assume that at time T3, the value of signal 18 increases to substantially the forward voltage of LEDs 12-14. Since transistor 68 is enabled, current 69 begins to flow through LEDs 12-14. Because switch 67 is closed, amplifier 61 cannot regulate current 69 and current 69 begins to increase causing signal 86 to also increase. The increased value of signal 86 causes amplifier 49 to reduce the value of signal 50 to a value that disables transistor 56. The lower value of signal 50 also opens switch 67 which configures amplifier 61 to regulate the value of current 69 so that the waveform of current 69 substantially follows the waveform of signal 35, thus substantially the waveform of signal 18, thereby providing power factor correction. An embodiment may include that transistor 68 operates in the linear operational region to regulate current 69. During this interval, transistors 46 and 56 are disabled and the corresponding current regulators do not regulate any LED current.

At a time T4, the value of signal 18 further increases to be substantially equal to the forward voltage of LEDs 12-15, thus, current 82 begins to flow through transistor 81. Since switch 80 remains closed, amplifier 74 does not regulate current 82 which causes the value of signal 86 to increase. The increased value of signal 86 forces the output of amplifier 61 low to a value less than the threshold voltage of transistor 68 thereby disabling transistor 68 and terminating current 69. The decrease value of signal 62 also opens switch 80 thereby configuring amplifier 74 to regulate the value of current 82 to have a waveform that is substantially equal to the waveform of signal 35, thus signal 18, thereby providing power factor correction. An embodiment may include that transistor 81 operates in the linear operational region to regulate current 82. During this interval, transistors 46, 56, and 68 are disabled and the corresponding current regulators do not regulate any LED current.

At a time T5, the value of signal 18 decrease to be less than the forward voltage of LEDs 12-15 but greater than the forward voltage of LEDs 12-14, thus, LED 15 can no longer conduct current. Since at the time T5 transistor 46, 56, and 68 are disabled, the value of signal 86 decreases substantially. The decreased value of signal 86 forces the output of amplifier 74 high to a value more than the threshold voltage of transistor 81 thereby keeping transistor 81 enabled and ready for operation during next half AC cycle. The increased value of signal 75 also close switch 60 thereby connecting signal 35 to the non-inverting input of amplifier 61 which causes signal 62 to increase to close or equal to the threshold voltage of transistor 68. This causes transistor 68 to operating in the linear operation range thereby allowing the current of LEDs 12-14 to flow through transistor 68. Thus amplifier 61 regulates the value of current 69 to follow the waveform of signal 35.

At a time T6, the value of signal 18 decrease further to be less than the forward voltage of LEDs 12-14 but greater than the forward voltage of LEDs 12-13, thus, LED 14 can no longer conduct current. Since at the time T6 transistor 46 and 56 are still disabled, the value of signal 86 decreases substantially. The decreased value of signal 86 forces the output of amplifier 61 high to a value more than the threshold voltage of transistor 68 thereby keep transistor 68 enabled and ready for operation during the next half AC cycle. The increased value of signal 62 also close switch 48 therefore connecting reference signal 35 to the non-inverting input of amplifier 49 which causes signal 50 to increase to close or equal to the threshold voltage of transistor 56. This causes transistor 56 to operate in the linear operation range thereby allowing the current of LEDs 12-13 to flow through transistor 56. Thus amplifier 49 regulates the value of current 57 to follow the waveform of signal 35. The increase value of signal 62 also close switch 80 which keeps transistor 81 enabled and ready for operation during next half AC cycle.

At a time T7, the value of signal 18 decreases further to be less than the forward voltage of LEDs 12-13 but greater than the forward voltage of LED 12, thus, LED 13 can no longer conduct current. Since at time T6 transistor 46 is still disabled, the value of signal 86 decreases substantially. The decreased value of signal 86 forces the output of amplifier 49 high to a value more than the threshold voltage of transistor 56 thereby keep transistor 56 enabled and ready for operation during next half AC cycle. The increased value of signal 50 also close switch 38 which connects reference signal 35 to the non-inverting input of amplifier 39 which causes signal 40 to increase to close or equal to the threshold voltage of transistor 46. This causes transistor 46 to operate in the linear operation range thereby allowing the current of LED 12 to flow through transistor 46. Thus amplifier 39 regulates the value of current 47 to follow the waveform of signal 35. The increased value of signal 50 also close switch 67 which keeps transistor 68 enabled and ready for operation during next half AC cycle.

At a time T8, the value of signal 18 decrease further to be less than the forward voltage of LED 12 thus, LED 12 can no longer conduct current, and the value of signal 86 decreases substantially. The decreased value of signal 86 forces the output of amplifier 40 high to a value more than the threshold voltage of transistor 46 thereby keeping transistor 46 enabled and ready for operation during next half AC cycle. The increased value of signal 40 also close switch 55 which furthermore keeps transistor 56 enabled and ready for operation during next half AC cycle.

In order to facilitate the herein described functionality, input 21 of circuit 20 may be configured to receive signal 18 and to be coupled to a first terminal of resistor 30. A second terminal of resistor 30 may be commonly connected to a first terminal of resistor 31 and to an input of circuit 34. A second terminal of resistor 31 may be connected to input 22. An output of circuit 34 may be commonly connected to a first terminal of switch 38, a first terminal of switch 48, a first terminal of switch 60, and to a first input of amplifier 74. A second terminal of switch 38 may be commonly connected to a non-inverting input of amplifier 39 and a first terminal of a resistor 42. A second terminal of resistor 42 may be connected to a first terminal of reference 43 and has a second terminal connected to return 42. An inverting input of amplifier 39 may be connected to a first terminal of resistor 41 which has a second terminal commonly connected to a source of transistor 46 and a first terminal of resistor 85. An output of amplifier 39 may be commonly connected to a gate of transistor 46 and to a control input of switch 55. A drain of transistor 46 is connected to input 24. A second terminal of switch 48 may be commonly connected to a non-inverting input of amplifier 49 and to a first terminal of resistor 52. A second terminal of resistor 52 may be connected to a first terminal of source 53 which has a second terminal connected to input 22 and to a first terminal of switch 55. A second terminal of switch 55 may be commonly connected to an inverting input of amplifier 49 and to a first terminal of resistor 51. A second terminal of resistor 51 may be connected to the first terminal of resistor 85. An output of amplifier 49 may be commonly connected to a control input of switch 38, a gate of transistor 56, and a control input of switch 67. A drain of transistor 56 may be connected to input 25. A second terminal of switch 60 may be commonly connected to a first terminal resistor 65 and a non-inverting input of amplifier 61. A second terminal of resistor 65 may be connected to a first terminal of source 64 which has a second terminal connected to input 22 and a first terminal of switch 67. A second terminal of switch 67 is connected to an inverting input of amplifier 61 and a first terminal of resistor 63. A second terminal of resistor 63 is connected to the first terminal of resistor 85. An output of amplifier 61 is commonly connected to a control input of switch 48, a gate of transistor 68, and a control input of switch 80. A first terminal of switch 80 is connected to an inverting input of amplifier 74 and to a first terminal of resistor 76. A second terminal of switch 80 is connected to input 22. A second terminal of resistor 76 is connected to the first terminal of resistor 85. An output of amplifier 74 is commonly connected to a control input of switch 60 and a gate of transistor 81. A drain of transistor 81 is connected to input 27. A source of transistor 81 is commonly connected to the first terminal of resistor 85, a source of transistor 68, and a source of transistor 56. A second terminal of resistor 85 is connected to input 22. Detect circuit 88 has an output connected to a control input of circuit 34. An input of circuit 88 is connected to the output of at least one of amplifiers 39, 49, 61, or 74.

Forming the regulator circuits to form currents 47, 57, 69, and 82 to have a waveform that follows the waveform of signal 18, or alternately signal 35, reduces the total harmonic distortion that is formed in the AC line current.

Figure 3:
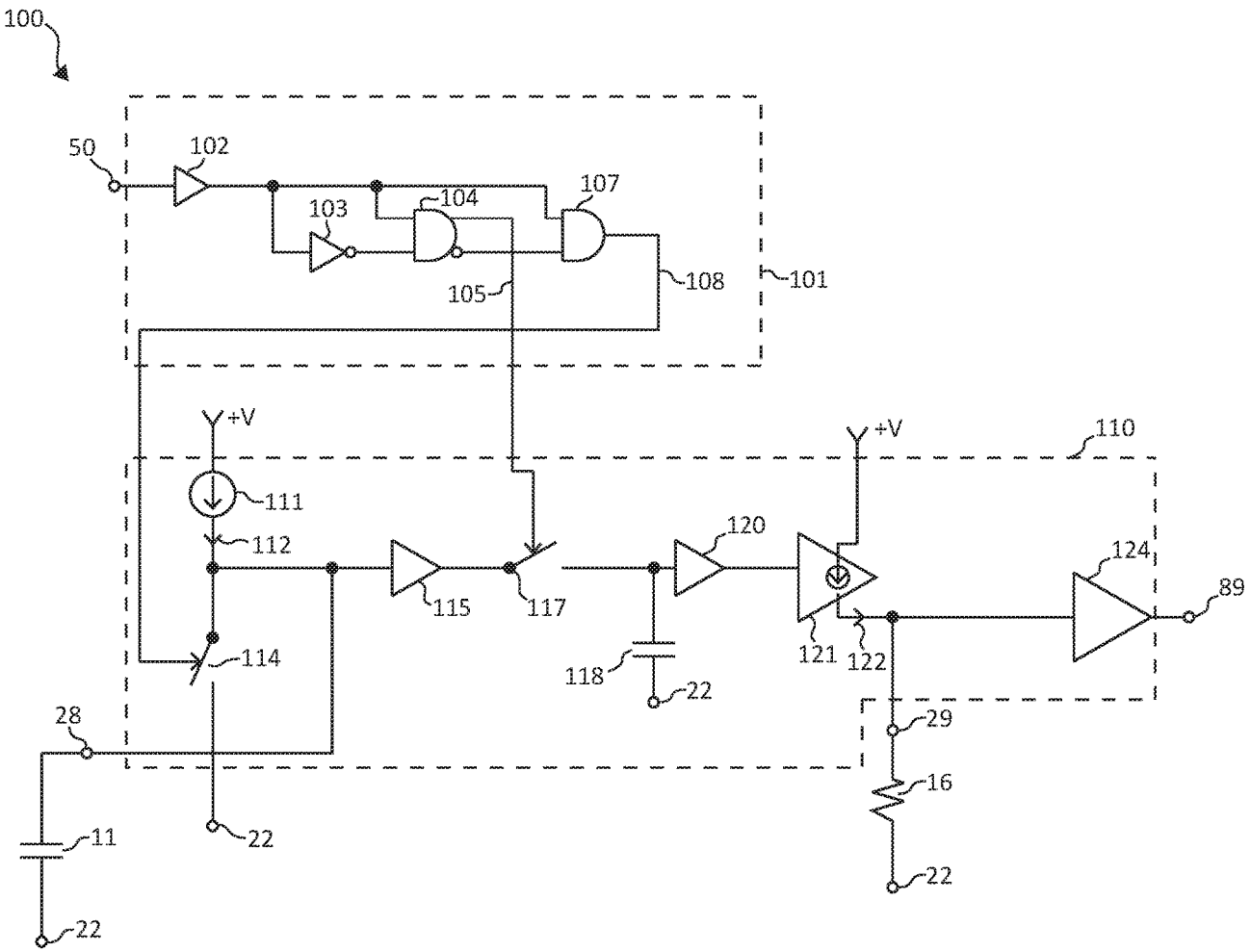
FIG. 3 schematically illustrates an example of an embodiment of a portion of a circuit that may be an alternate embodiment of one of the circuits of FIG. 1 in accordance with the present invention.

FIG. 3 schematically illustrates an example of an embodiment of an optional detect circuit 100 that may be an alternate embodiment of circuit 88 in FIG. 1. Circuit 100 includes a trigger circuit 101 and a signal circuit 110.

Circuit 100 may have an embodiment that may be configured to charge a capacitor 11 with a current source 111 during the on-time of one of LEDs 12-15, and to store that value on capacitor 118 at or near to the end of the corresponding on-time. In an embodiment, circuit 101 may be configured to receive signal 50, generate a corresponding sampling pulse 105 for sampling the charge accumulated on capacitor 11, and hold that value on capacitor 118 at or near to the end of the corresponding on-time. Then, circuit 101 may generate a reset signal 108 for resetting capacitor 11.

In one embodiment, circuit 110 may be configured to sense the on-time of LED 14 by charging capacitor 11 during the conduction time of LED 14 and sampling and holding the charge of capacitor 11 on a holding capacitor 118 at the end of the conduction of the LED 14. As explained hereinbefore, as the rectified AC line voltage increases at the beginning of the input AC line voltage cycle, LEDs 12-15 turn on in sequence beginning with LED 12. Also as explained hereinbefore, at the onset of conduction of LED 14, transistor 56 is turned off by negating signal 50. When signal 50 is negated, circuit 101 negates signal 108 thereby opening switch 114 to allow a current source 111 to charge capacitor 11 with current 112.

Also as explained hereinbefore, LED 14 remains on and conducting until the value of signal 18 decreases to a value that is less than the total forward voltages of LEDs 12-14, thus, current through LED 14 becomes substantially zero. At that stage, current 57 flows through LEDs 12-13 and transistor 56. At the end of conduction of LED 14, transistor 56 is again turned-on by amplifier 49 asserting signal 50. In response, to asserting signal 50, circuit 101 generates a pulse on signal 105 thereby closing switch 117 for a very short time period (e.g., a few micro-second) to allow the charge on capacitor 11 to be reflected to capacitor 118. The output response of inverter 103 may be configured with certain amount delay time to form the short time period of signal 105. Then, after signal 105 is negated and while signal 50 is asserted, circuit 101 asserts signal 108 thereby closing switch 114 to discharge capacitor 11. The charge on capacitor 118 may, in an embodiment, be representative of the on-time of LED 14.

A transconductance amplifier 121 may be configured to form a current 122 that is proportional to the charge on capacitor 118. Current 122 forms a voltage across resistor 19 that is proportional to the on-time of LED 14. An optional buffer amplifier 124 may drive signal 89 to have a value that is proportional to the on-time. Referring back to FIG. 1, circuit 34 receives signal 89 and may, in an embodiment, adjust the maximum amplitude of signal 35 inversely proportional to the on-time.

Referring back to FIG. 3, a reset switch 114 may be closed prior to beginning the on-time to reset the voltage on capacitor 11. Current source 111 changes capacitor 11 with a current 112 during the on-time. A switch 117 is close briefly at or near to the end of the on-time to store the value of capacitor 11 on capacitor 118. Circuit 110 may include optional buffers 115 and 120.

An embodiment of circuit 101 may include that an input of circuit 101 may be connected to a first terminal of an optional buffer 102. An output of buffer 102 may be commonly connected to an input of inverter 103, and input of an AND gate 104, and an input of an AND gate 107. An output of gate 107 may be configured to form signal 108 to control switch 114. An output of inverter 103 may be connected to another input of gate 104. A non-inverting output of gate 104 may be configured to control switch 117. An inverting output of gate 104 may be connected to another input of gate 107.

Circuit 110 may include an embodiment wherein a first terminal of switch 114 is connected to input 22. A second terminal of switch 114 may be commonly connected to a first terminal of current source 111, a first input of buffer 115, and to input 28 in order to be configured to be coupled to a first terminal of capacitor 11. An output of buffer 115 may be connected to a first terminal of switch 117. A control input of switch 117 may be connected to the non-inverting output of gate 104. A second terminal of switch 117 may be commonly connected to a first terminal of capacitor 118 and an input of buffer 120. An output of buffer 120 may be connected to an input of amplifier 121. A current output of amplifier 121 may be commonly connected to an input of buffer 124 and to input 29 which may be configured to be coupled to a first terminal of resistor 16.

Figure 4:
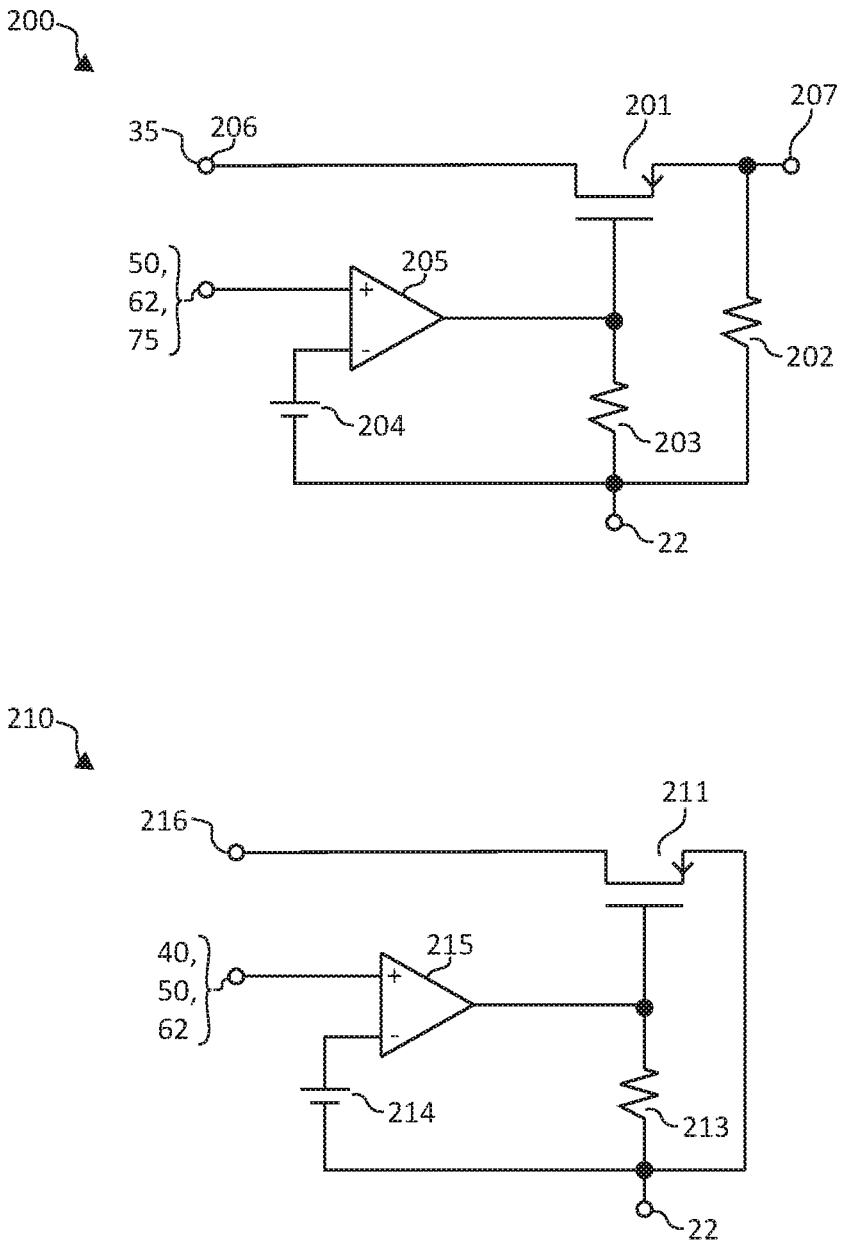
FIG. 4 schematically illustrates an example of portions of embodiments of switch circuits that may be an alternate embodiment of portions of at least some of the switches of the circuits in FIG. 1 in accordance with the present invention.

FIG. 4 schematically illustrates an example of a portion of an embodiment of a switch circuit 200 that may be an alternate embodiment of any one of switches 38, 48, or 60, and a switch circuit 210 that may be alternate embodiment of any one of switches 55, 67, or 80.

Switch 200 includes a first terminal 206 that may be connected to receive signal 35, and a second terminal 207 that may be connected to the respective one of nodes 37, 54, or 59. A transistor 201 has a drain connected to input 206 and a source connected to terminal 207. A resistor 201 is connected between output 207 and input 22. A control input of circuit 200 is connected to a non-inverting input of a comparator 205, and connected to receive the respective one of signals 50, 62, or 75. An inverting input of comparator 205 is connected to receive a reference signal from an offset circuit 204. An output of comparator 205 is connected to a gate of transistor 201 and to a first terminal of a resistor 203 which has a second terminal connected to input 22. The value of offset 204 may be selected to enable transistor 201 in response to the respective signal 50, 62, or 75 having a value greater than the value of the threshold voltage of the respective one of transistors 56, 68, and 81.

Switch 210 includes a first terminal 216 that may be connected to the inverting input of the respective one of comparators 49, 61, and 74. A transistor 211 has a drain connected to input 216 and a source connected to input 22. A control input of circuit 210 is connected to a non-inverting input of a comparator 215, and connected to receive the respective one of signals 40, 50, or 62. An inverting input of comparator 215 is connected to receive a reference signal from an offset circuit 214. An output of comparator 215 is connected to a gate of transistor 211 and to a first terminal of a resistor 213 which has a second terminal connected to input 22. The value of offset 214 may be selected to enable transistor 211 in response to the respective signal 40, 50, or 62 having a value no less than some fraction of the value of the threshold voltage of the respective one of transistors 56, 68, or 81.

Figure 5:
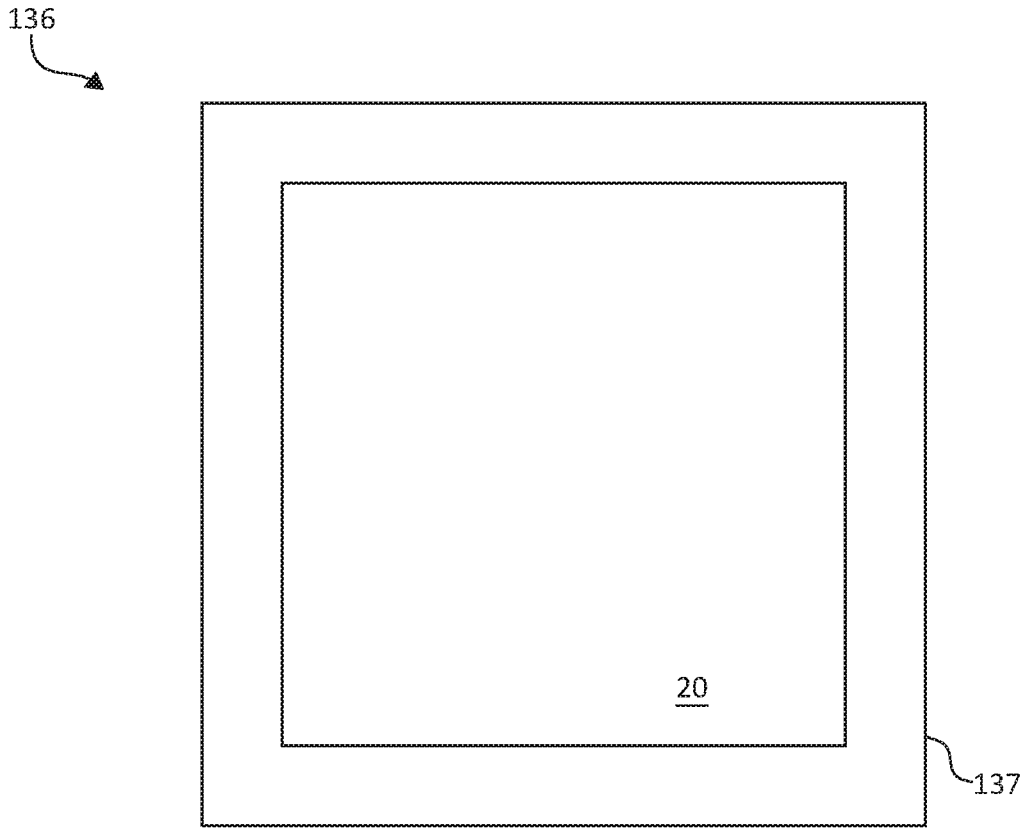
FIG. 5 illustrates an enlarged plan view of a semiconductor device that may include at least a portion of the system of FIG. 1 in accordance with the present invention.

FIG. 5 illustrates an enlarged plan view of a portion of an embodiment of a semiconductor device or integrated circuit 136 that is formed on a semiconductor die 137. In an embodiment, controller 20 may be formed on die 137. Die 137 may also include other circuits that are not shown in FIG. 5 for simplicity of the drawing. The controller and device or integrated circuit 136 may be formed on die 137 by semiconductor manufacturing techniques that are well known to those skilled in the art.

From all the foregoing, one skilled in the art will understand that an example of an embodiment of an LED control circuit may comprise:

a first input, such as for example input 24, configured to be coupled to a first terminal of a first LED, such as for example LED 12;

a second input, such as for example input 25, configured to be coupled to a first terminal of a second LED, such as for example LED 13, that is coupled in series with the first LED;

a first circuit, such as for example circuit 34, configured to form a reference signal, such as for example signal 35, having it waveform of a rectified ac voltage;

a first regulator circuit, such as for example the circuit of amplifier 34 and transistor 46 and resistor 41, configured to receive the reference signal and regulate a first current through the first LED in response to a first portion of the reference signal wherein the reference signal is increasing from a first value to a second value; and a second regulator circuit, such as for example any of the regulator circuits that may include amplifier 49 or amplifier 61 or amplifier 74, configured to receive the reference signal and regulate a second current through the first LED and through a second LED in response to a second portion of the reference signal wherein the reference signal is increasing from the second value to a third value wherein the first regulator circuit does not regulate the first current or the second current during the second portion.

An embodiment of the LED control circuit may also include that the first regulator circuit may be also configured to regulate the first current through the first LED in response to the reference signal decreasing from the second value to the first value.

In an embodiment, the second regulator circuit may include a first amplifier, such as for example amplifier 49, configured to drive a first transistor, such as for example transistor 56, to conduct the second current, such as for example current 57, during the second portion of the reference signal.

An embodiment may include that the first regulator circuit may include a second amplifier, such as for example amplifier 39, configured to drive a second transistor, such as for example transistor 46, to conduct the first current, such as for example current 47, during the first portion of the reference signal, such as for example a portion where the amplitude is less than the threshold voltage of LED 13, and to enable the first amplifier in response to the second portion of the reference signal.

The first regulator circuit may have an embodiment that may include a switch, such as for example a switch 38, configured to decouple the second amplifier from receiving the reference signal in response to the first amplifier, such as for example amplifier 49, driving the first transistor.

An embodiment may include that the second regulator circuit may include a switch, such as for example switch 55, configured to force an input of the first amplifier, such as for example amplifier 49, to a common reference voltage in response to the second amplifier, such as for example amplifier 39, driving the second transistor, such as for example transistor 46.

An embodiment of the LED control circuit may also include a third regulator circuit, such as for example the regulator circuit that includes either amplifier 61 or amplifier 74, configured to receive the reference signal and regulate a third current, such as for example one of currents 69 or 82, through the first LED and the second LED and a third LED, such as for example LED 14 or 15, in response to a third portion of the reference signal wherein the reference signal is increasing from the third value to a fourth value wherein the first regulator circuit and the second regulator circuit do not regulate the first current or the second current or the third current during the third portion.

The third regulator circuit may have an embodiment that may include an amplifier, such as for example amplifier 61 or 74, configured to drive a transistor, such as for example transistor 68 or 81, to conduct the third current, such as for example current 69 or 82, during the third portion of the reference signal.

An embodiment of the second regulator circuit may also include a switch, such as for example switch 48, configured to decouple an amplifier, such as for example amplifier 49, of the second regulator circuit from receiving the reference signal in response to the amplifier, such as for example amplifier 61, of the third reference signal driving the transistor, such as for example transistor 68, of the third reference circuit to conduct the third current, such as for example current 69.

Those skilled in the art will also understand that an embodiment of a control circuit for regulating an LED current may comprise:

an input, such as for example input 21, configured to receive an input signal having a waveform that is representative of a rectified ac voltage;

a plurality of regulator circuits, such as for example one of the regulator circuits that include any one of amplifiers 39 49 61 or 74, with each regulator circuit configured to be coupled to a terminal of an LED of a plurality of series coupled LEDs, such as for example one of LEDs 12-15;

the control circuit configured to couple a first regulator circuit, such as for example the regulator that includes amplifier 39 resistor 41 and transistor 46, of the plurality of regulator circuits to receive a first LED current, such as for example current 47, from a first LED of the plurality of series coupled LEDs and regulate the first LED current during a first portion of the input signal, such as for example a portion having an amplitude that is less than a threshold voltage of LED 13, to have a waveshape that follows the input signal waveform wherein the input signal increases from a first value to a second value and wherein the first regulator circuit does not regulate the first LED current during a second portion of the input signal; and the control circuit configured to couple a second regulator circuit, such as for example one of the regulator circuits that includes either amplifier 49 or 61 or 74, of the plurality of regulator circuits to receive a second LED current, such as for example one of currents 57 469 or 82, from the first LED, such as for example LED 12 and from a second LED, such as for example one of LEDs 13 or 14 or 15, of the plurality of series coupled LEDs and regulate the second LED current during a second portion of the input signal to have a waveshape that follow the input signal waveform wherein the input signal increases from a value no less than the second value to a third value and wherein the second regulator circuit does not regulate the second LED current during the first portion or a third portion of the input signal.

An embodiment may include that the second regulator circuit may be configured to regulate the second LED current during a third portion of the input signal wherein the input signal decreases from approximately the third value to approximately the second value.

In an embodiment, the first regulator circuit may be configured to regulate the first current during a fourth portion of the input signal wherein the input signal decreases from approximately the second value to approximately the first value.

An embodiment may include that the first regulator circuit may include a first amplifier, such as for example amplifier 39, and a first switch, such as for example switch 38, wherein the first switch is configured to decouple a reference signal from the first amplifier in response to the second regulator circuit, such as for example the regulator that includes amplifier 49, regulating the second LED, such as for example current 57, in a waveshape of the reference signal is representative of a waveshape of the input signal.

The second regulator circuit may have an in body method that may include a second amplifier, such as for example amplifier 49, and a second switch, such as for example switch 55, wherein the second switch is configured to inhibit the second amplifier from forming the second LED current, such as for example current 57, in response to the first regulator circuit, such as for example amplifier 39, regulating the first LED current, such as for example current 47 and.

An embodiment of the control circuit may also include a third regulator circuit, such as for example the regulator circuit that includes one of amplifier 61 or 74, of the plurality of regulator circuits configured to receive a third LED current, such as for example one of currents 69 or 82, from the first LED (12), from the second LED, such as for example one of LEDs 13 or 14, and from a third LED, such as for example one of LEDs 14 or 15, of the plurality of series coupled LEDs and regulate the third LED current during a third portion of the input signal to have a waveshape that follow the input signal waveform wherein the input signal increases from a value no less than the third value to a fourth value and wherein the third regulator circuit does not regulate the third LED current during the first portion or the second portion or a fourth portion of the input signal.

An embodiment may also include that the second regulator circuit may include a first switch, such as for example switch 48, configured to decouple a reference signal from the second regulator in response to the third regulator circuit, such as for example the regulator that includes amplifier 61, regulating the third LED current wherein a waveshape of the reference signal is representative of a waveshape of the input signal; and the third regulator circuit including a second switch, such as for example switch 67, configured to inhibit the third regulator circuit from regulating the third current in response to the second regulator circuit regulating the second LED current.

In an embodiment, the third regulator circuit may include an amplifier, such as for example amplifier 61, and a third switch, such as for example switch 60, wherein a first input of the amplifier is coupled to the third switch and a second input of the amplifier is coupled to the second switch.

Those skilled in the art will also appreciate that an example of a method of forming an LED control circuit may comprise:

configuring a first circuit, such as for example circuit 34, to form a reference signal, such as for example signal 35, having a waveform of a rectified ac signal;

configuring a first regulator circuit, such as for example circuit 39, to regulate a first LED current from a first LED during a first portion of the reference signal to have a waveshape that substantially follows the reference signal waveform but not receive the first current during a second portion of the reference signal; and configuring a second regulator circuit, such as for example the regulator that includes amplifier 49, to regulate a second current from the first LED and from a second LED during the second portion of the reference signal to have a waveshape that substantially follows the reference signal waveform.

An embodiment of the method may also include configuring the second regulator circuit to not regulate the second current during the first portion of the reference signal.

The method may also have an embodiment may include configuring a third regulator circuit, such as for example the regulator that includes amplifier 61, to regulate a third LED current that flows through the first LED, the second LED, and a third LED during a third portion of the reference signal but not during the first portion or the second portion of the reference signal wherein the first regulator circuit and the second regulator circuit do not regulate the first, second, or third LED currents during the third portion of the reference signal.

In view of all of the above, it is evident that a novel device and method is disclosed. Included, among other features, is forming a reference circuit to form a reference signal that has a waveform that substantially follows a waveform of a rectified ac input signal. One or more regulator circuits are formed to regulate an LED current to have a waveform to follows the waveform of the reference signal, thus, the waveform of the input signal. Forming the LED current to follow the waveform of the reference signal assists in reducing the total harmonic distortion that is created in the AC line current.

While the subject matter of the descriptions are described with specific preferred embodiments and example embodiments, the foregoing drawings and descriptions thereof depict only typical and non-limiting examples of embodiments of the subject matter and are not therefore to be considered to be limiting of its scope, it is evident that many alternatives and variations will be apparent to those skilled in the art. As will be appreciated by those skilled in the art, the example form of system 10 and controller 20 are used as a vehicle to explain the operation method of forming the LED current to substantially follow the waveshape of the rectified ac input signal. Those skilled in the art will understand that circuit 34 and each regulator circuit may have other embodiments as long as the regulator circuit regulates the LED current to have a waveform that substantially follows the waveform of the input signal.

As the claims hereinafter reflect, inventive aspects may lie in less than all features of a single foregoing disclosed embodiment. Thus, the hereinafter expressed claims are hereby expressly incorporated into this Detailed Description of the Drawings, with each claim standing on its own as a separate embodiment of an invention. Furthermore, while some embodiments described herein include some but not other features included in other embodiments, combinations of features of different embodiments are meant to be within the scope of the invention, and form different embodiments, as would be understood by those skilled in the art.

The invention claimed is:

1. An LED control circuit comprising:

a first input configured to be coupled to a first terminal of a first LED;

a second input configured to be coupled to a first terminal of a second LED that is coupled in series with the first LED;

a first circuit configured to form a reference signal having a waveform of a rectified ac voltage;

a first regulator circuit configured to receive the reference signal and regulate a first current through the first LED in response to a first portion of the reference signal wherein the reference signal is increasing from a first value to a second value; and a second regulator circuit configured to receive the reference signal and regulate a second current through the first LED and through the second LED in response to a second portion of the reference signal wherein the reference signal is increasing from the second value to a third value and wherein the first regulator circuit is decoupled from receiving the reference signal in response to the second regulator circuit regulating the second current so that the first regulator circuit does not regulate the first current or the second current during the second portion.

2. The LED control circuit of claim 1 wherein the first regulator circuit is also configured to regulate the first current through the first LED in response to the reference signal decreasing from the second value to the first value.

3. The LED control circuit of claim 1 wherein the second regulator circuit includes a first amplifier configured to drive a first transistor to conduct the second current during the second portion of the reference signal.

4. The LED control circuit of claim 3 wherein the first regulator circuit includes a second amplifier configured to drive a second transistor to conduct the first current during the first portion of the reference signal and to enable the first amplifier in response to the second portion of the reference signal.

5. The LED control circuit of claim 4 wherein the first regulator circuit includes a switch configured to decouple the second amplifier from receiving the reference signal in response to the first amplifier driving the first transistor.

6. The LED control circuit of claim 4 wherein the second regulator circuit includes a switch configured to force an input of the first amplifier to a common reference voltage in response to the second amplifier driving the second transistor.

7. The LED control circuit of claim 1 further including a third regulator circuit configured to receive the reference signal and regulate a third current through the first LED and the second LED and a third LED in response to a third portion of the reference signal wherein the reference signal is increasing from the third value to a fourth value and wherein the first regulator circuit and the second regulator circuit do not regulate the first current or the second current or the third current during the third portion.

8. The LED control circuit of claim 7 wherein the third regulator circuit includes an amplifier configured to drive a transistor to conduct the third current during the third portion of the reference signal.

9. The LED control circuit of claim 8 wherein the second regulator circuit includes a switch configured to decouple an amplifier of the second regulator circuit from receiving the reference signal in response to the amplifier of the third reference signal driving the transistor of the third reference circuit to conduct the third current.

10. A control circuit for regulating an LED current comprising:

an input configured to receive an input signal having a waveform that is representative of a rectified ac voltage;

a plurality of regulator circuits with each regulator circuit configured to be coupled to a terminal of an LED of a plurality of series coupled LEDs;

the control circuit configured to couple a first regulator circuit of the plurality of regulator circuits to receive a first LED current from a first LED of the plurality of series coupled LEDs and regulate the first LED current during a first portion of the input signal to have a waveshape that follows the input signal waveform wherein the input signal increases from a first value to a second value and wherein the first regulator circuit does not regulate the first LED current during a second portion of the input signal; and the control circuit configured to couple a second regulator circuit of the plurality of regulator circuits to receive a second LED current from the first LED and from a second LED of the plurality of series coupled LEDs and regulate the second LED current during a second portion of the input signal to have a waveshape that follow the input signal waveform wherein the input signal increases from a value no less than the second value to a third value and wherein the second regulator circuit does not regulate the second LED current during the first portion or a third portion of the input signal, the second regulator circuit having an inhibit switch configured to inhibit the second regulator circuit from regulating the first LED current in response to the first regulator circuit regulating the first LED current.

11. The control circuit of claim 10 wherein the second regulator circuit is configured to regulate the second LED current during a fourth portion of the input signal and wherein the input signal decreases from approximately the third value to approximately the second value.

12. The control circuit of claim 11 wherein the first regulator circuit is configured to regulate the first current during a fifth portion of the input signal wherein the input signal decreases from approximately the second value to approximately the first value.

13. The control circuit of claim 10 wherein the first regulator circuit includes a first amplifier and a first switch wherein the first switch is configured to decouple a reference signal from the first amplifier in response to the second regulator circuit regulating the second LED current wherein a waveshape of the reference signal is representative of a waveshape of the input signal.

14. The control circuit of claim 13 wherein the second regulator circuit includes a second amplifier and the inhibit switch wherein the inhibit switch is configured to inhibit the second amplifier from forming the second LED current in response to the first regulator circuit regulating the first LED current.

15. The control circuit of claim 10 further including a third regulator circuit of the plurality of regulator circuits configured to receive a third LED current from the first LED, from the second LED, and from a third LED of the plurality of series coupled LEDs and regulate the third LED current during the third portion of the input signal to have a waveshape that follow the input signal waveform wherein the input signal increases from a value no less than the third value to a fourth value and wherein the third regulator circuit does not regulate the third LED current during the first portion or the second portion or a fourth portion of the input signal.

16. The control circuit of claim 15 wherein the second regulator circuit includes a first switch configured to decouple a reference signal from the second regulator in response to the third regulator circuit regulating the third LED current wherein a waveshape of the reference signal is representative of a waveshape of the input signal; and the third regulator circuit including a second switch configured to inhibit the third regulator circuit from regulating the third current in response to the second regulator circuit regulating the second LED current.

17. The control circuit of claim 16 wherein the third regulator circuit includes an amplifier and a third switch wherein a first input of the amplifier is coupled to the third switch and a second input of the amplifier is coupled to the second switch.

18. A method of forming an LED control circuit comprising:

configuring a first circuit to form a reference signal having a waveform of a rectified ac signal;

configuring a first regulator circuit to regulate a first LED current from a first LED during a first portion of the reference signal to have a waveshape that substantially follows the reference signal waveform but not receive the first current during a second portion of the reference signal, the first regulator circuit having a first switch; and configuring a second regulator circuit to regulate a second current from the first LED and from a second LED during the second portion of the reference signal to have a waveshape that substantially follows the reference signal waveform including configuring the second regulator circuit to disable the first switch to decouple the first regulator from receiving the reference signal so that the first regulator circuit does not regulate the first current or the second current during the second portion.

19. The method of claim 18 including configuring the second regulator circuit to not regulate the second current during the first portion of the reference signal.

20. The method of claim 19 further including configuring a third regulator circuit to regulate a third LED current that flows through the first LED, the second LED, and a third LED during a third portion of the reference signal but not during the first portion or the second portion of the reference signal wherein the first regulator circuit and the second regulator circuit do not regulate the first, second, or third LED currents during the third portion of the reference signal.

* * * * *